United States Patent [19]

Crolli

[11] 4,249,671

[45] Feb. 10, 1981

[54] CARRYING CASE

[75] Inventor: Gary M. Crolli, Erie, Pa.

[73] Assignee: Rehrig Pacific Company, Los Angeles, Calif.

[21] Appl. No.: 29,200

[22] Filed: Apr. 12, 1979

[51] Int. Cl.[3] ..... B65D 1/22; B65D 90/02

[52] U.S. Cl. ..... 220/469; 220/21; 220/83; 220/DIG. 15

[58] Field of Search ..... 220/21, 469, 83, DIG. 15

[56] References Cited

U.S. PATENT DOCUMENTS

| | | |
|---|---|---|
| 2,970,715 | 2/1961 | Kappel . |
| 3,353,704 | 11/1967 | Belcher . |
| 3,384,261 | 5/1968 | Austin . |
| 3,701,449 | 10/1972 | Schoeller . |
| 3,809,279 | 5/1974 | Arjas . |
| 3,841,519 | 10/1974 | Stromberg . |
| 3,982,654 | 8/1976 | Gottsegen . |
| 4,040,517 | 8/1977 | Torokvei . |

FOREIGN PATENT DOCUMENTS

| | | | |
|---|---|---|---|
| 2610855 | 9/1977 | Fed. Rep. of Germany | 220/21 |
| 973724 | 10/1964 | United Kingdom | 220/21 |

*Primary Examiner*—George E. Lowrance

*Attorney, Agent, or Firm*—Schuyler, Banner, Birch, McKie & Beckett

[57] ABSTRACT

A carrying case is described which has upstanding hollow walls comprising outer and inner walls interconnected by laterally spaced ribs. Portions of the inner wall are cut away to form openings which expose the interior of the hollow walls to facilitate their cleaning.

15 Claims, 9 Drawing Figures

CARRYING CASE

BACKGROUND OF THE INVENTION

1. Field of the Invention

This invention relates to carrying cases and, more particularly, to molded plastic carrying cases for holding an array of upstanding containers.

2. Description of the Prior Art

Widespread use has recently been made of beverage container or bottle carrying cases molded of high impact plastic. Cases of this type are superior to the older style wooden cases in that they are generally lighter in weight, more easily manufactured, more easily cleaned and not prone to the deterioration or wear and tear usually suffered by wooden cases.

Plastic cases have been constructed with hollow, apertured walls consisting of spaced outer and inner walls interconnected by means of webs or ribs. A wall of this type is much more rigid than a single thickness of the same quantity of material and provides an added measure of shock resistance. However, the interiors of these hollow walls have been quite difficult to clean. This problem has been a particular annoyance in the bottled beverage industry, where cleanliness of all portions of such a case is very important for sanitary reasons.

Several prior art solutions to this problem have been proposed. These include wall constructions having open tops and bottoms and drainage holes in the webs or ribs for the passage of washing fluid. However, these proposals have not been entirely satisfactory in facilitating reliable and efficient washing of hollow wall interiors.

SUMMARY OF THE INVENTION

It is therefore an object of the present invention to obviate the above-noted shortcomings of the prior art by providing a carrying case having a hollow wall of simple construction, the interior of which can be easily and reliably cleaned by conventional washing equipment.

Another object of the invention is to provide such a case which is lighter in weight than prior art hollow wall cases having similar dimensions.

Another object of the invention is to provide such a case wherein the interior of the hollow wall is partially exposed to the inside of the case to facilitate its cleaning.

These and other objects of the invention are achieved by providing a carrying case having a bottom wall and an upstanding hollow wall connected to the bottom wall, the hollow wall comprising an outer wall, an inner wall spaced inwardly from the outer wall and a plurality of openings formed in the inner wall to expose the interior of the hollow wall to facilitate its cleaning. The hollow wall may include a plurality of laterally spaced upstanding ribs interconnecting the outer and inner walls, the ribs defining the lateral edges of the openings. The openings generally have a height which is equal to at least one-half the height of the inner wall so as to expose a substantial portion of the interior of the hollow wall. The openings may also be spaced above the upper supporting surface of the bottom wall of the case. The ribs are connected directly to the outwardly facing peripheral edge of the bottom wall of the case. The connections between the ribs and the bottom wall are reinforced by an upstanding peripheral flange carried by the bottom wall and having an outwardly facing surface which is also connected to the ribs. The hollow wall may be substantially open from top to bottom to facilitate the cleaning of its interior.

BRIEF DESCRIPTION OF THE DRAWINGS

The novel features of the invention are set out with particularity in the appended claims, but the invention will be understood more fully and clearly from the following detailed description of a preferred embodiment of the invention as set forth in the accompanying drawings, in which:

DESCRIPTION OF A PREFERRED EMBODIMENT

Figure 1:
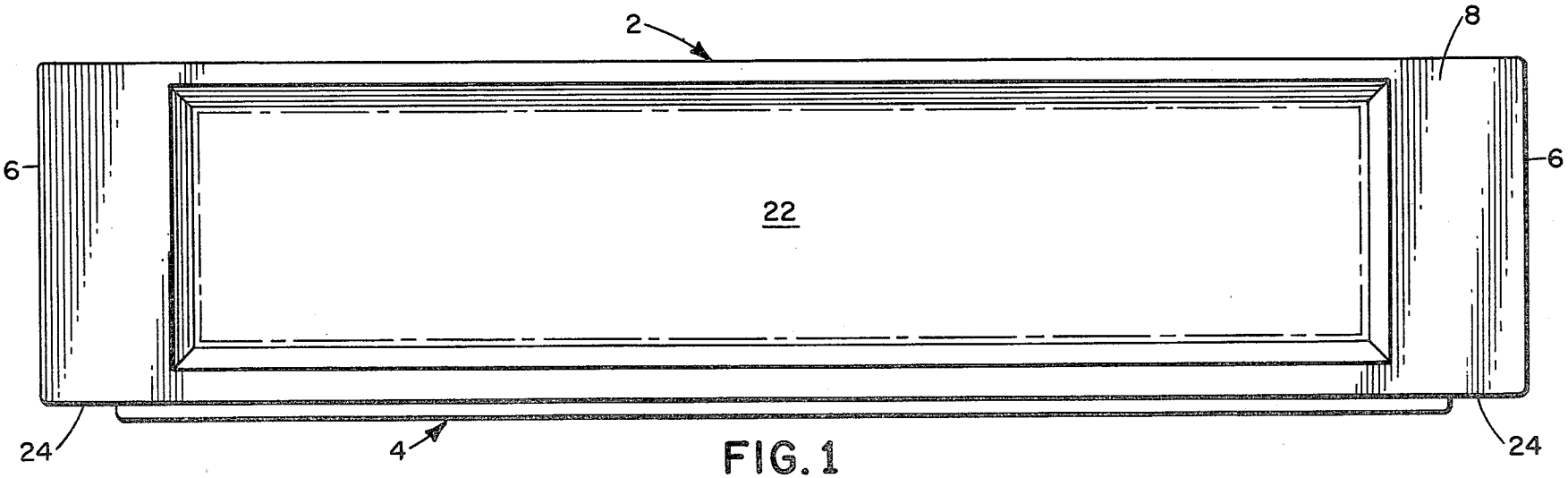
FIG. 1 is a side elevational view of the carrying case according to the invention.
Figure 2:
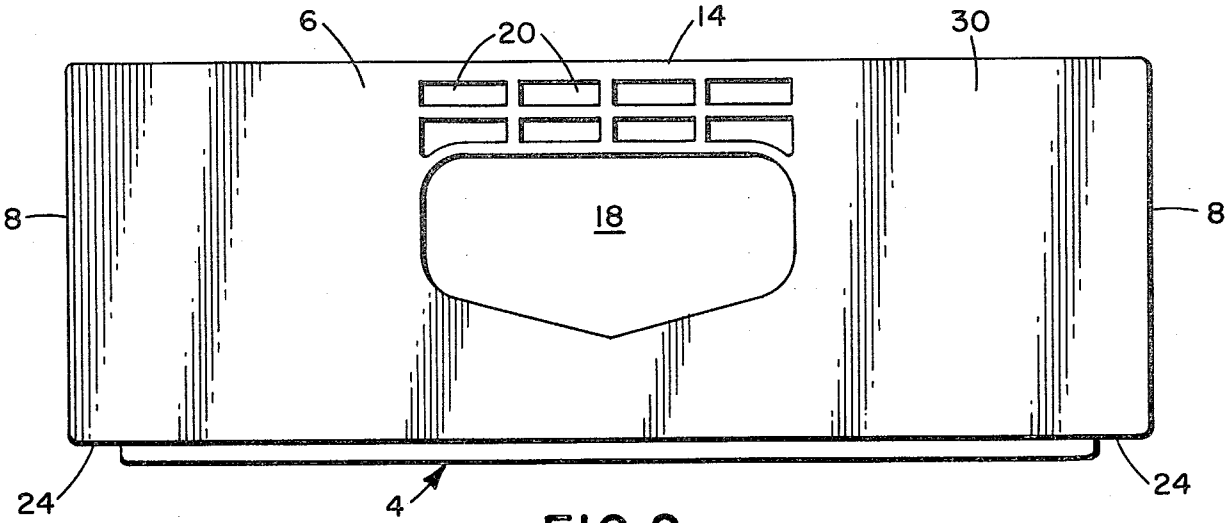
FIG. 2 is an end elevational view of the same.
Figure 3:
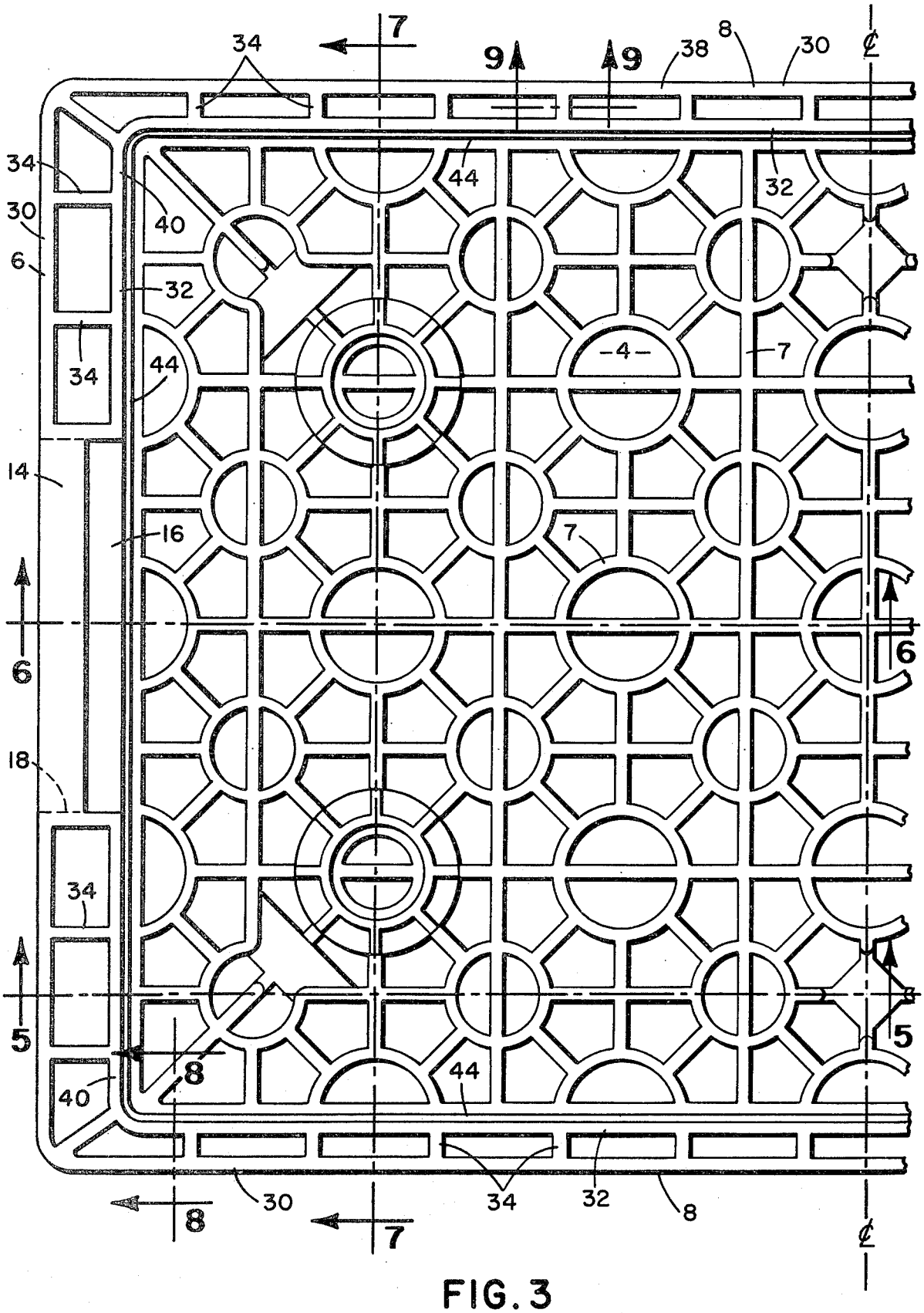
FIG. 3 is a partial top plan view of the same.
Figure 4:
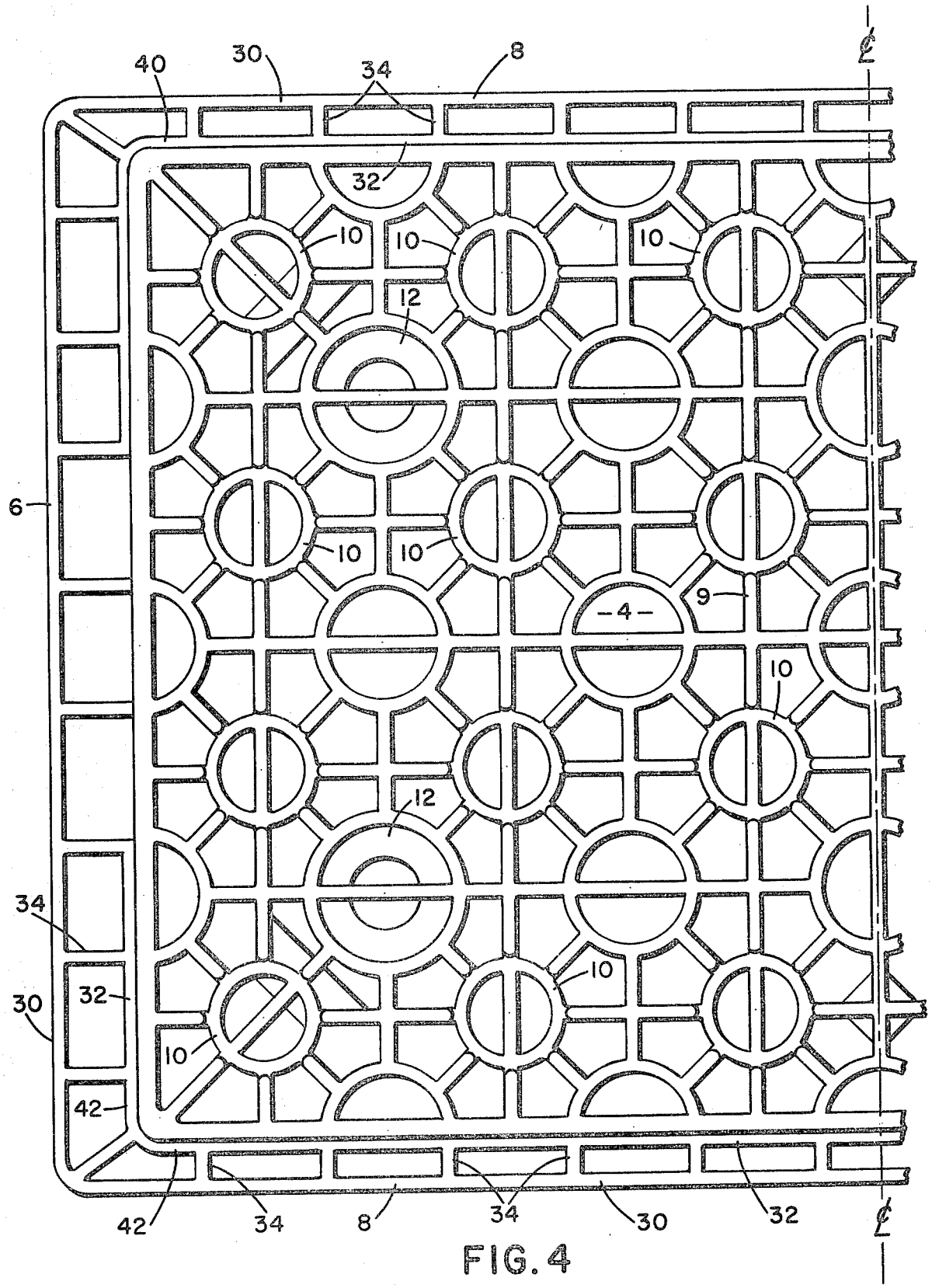
FIG. 4 is a partial bottom plan view of the same.
Figure 5:
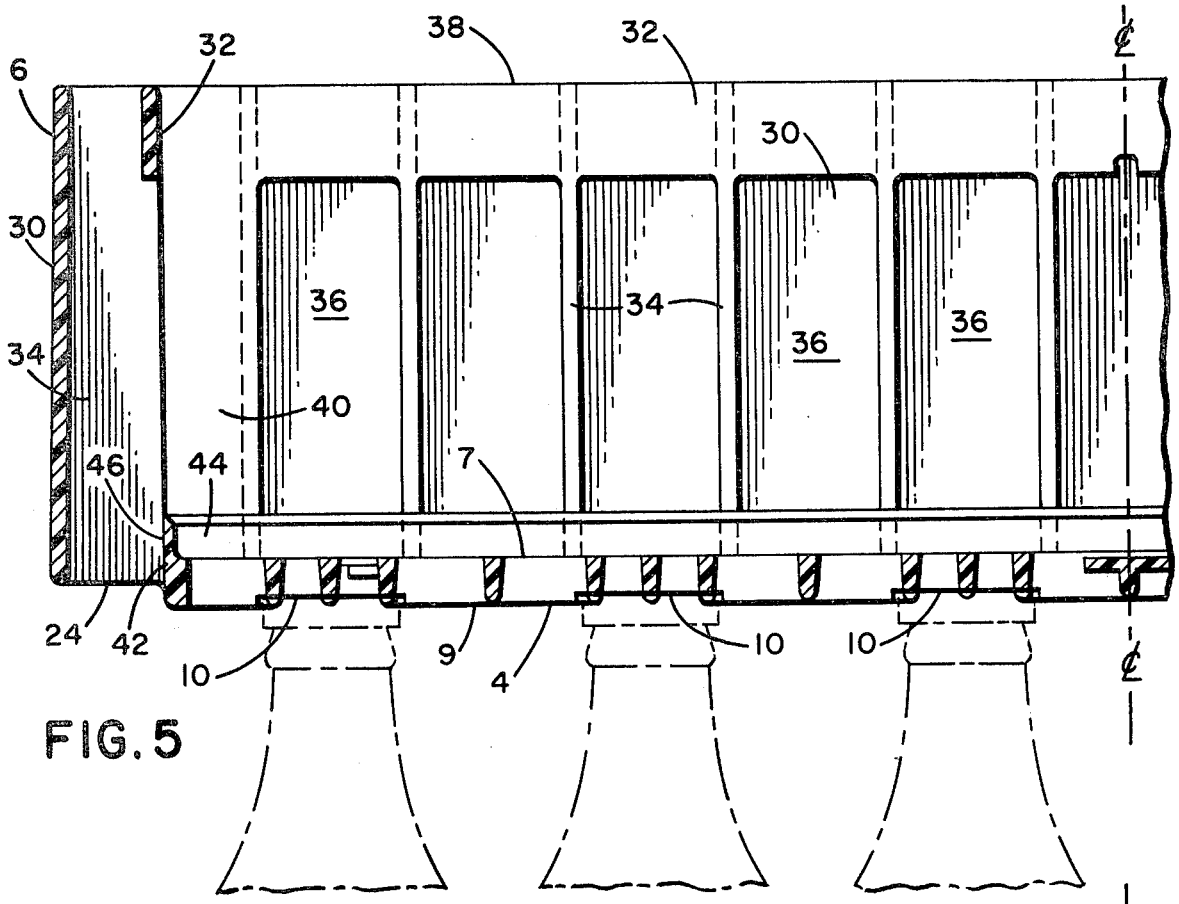
FIG. 5 is a partial sectional view of the same long line 5—5 of FIG. 3, showing the stacking feature of the case.
Figure 6:
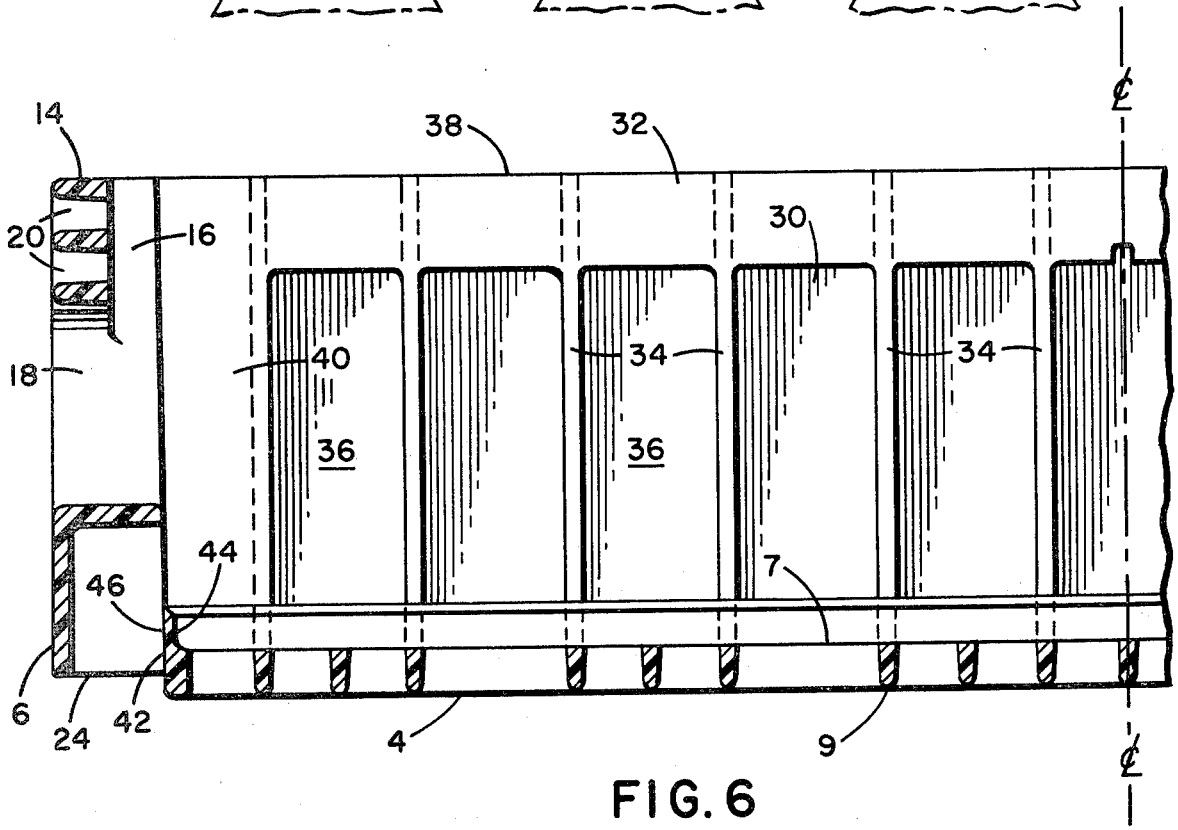
FIG. 6 is a partial sectional view of the same along line 6—6 of FIG. 3.

The description that follows relates to a molded plastic beverage bottle case, but it is to be understood that a carrying case constructed according to the invention may be made of any suitable material and used for carrying items of any type, size or shape.

Referring to FIGS. 1 through 6, carrying case 2 comprises an open lattice work bottom wall 4 joined to upstanding end walls 6 and side walls 8. Bottom wall 4 has an upper bottle-supporting surface 7, and a lower surface 9 which is provided with twenty-four bottle cap receiving recesses 10. Recesses 10 permit a plurality of these cases, when filled with beverage bottles, to be stacked in a number of stacking patterns (see FIG. 5). Of course, any number of recesses 10 may be provided depending on the size of the bottle to be carried. Bottom wall 4 also comprises four grommet slots 12 adapted to receive rubber grommets, if desired, when molded without central ribs 13. These grommets would serve to support the case on a flat surface and prevent unwanted lateral movement.

End walls 6 are provided with handles 14 and finger openings 18. Each handle 14 is recessed from the inner surface of end wall 6 to provide fingertip space 16 next to the adjacent bottles for fingers which are inserted through the opening 18 to grasp handle 14. Each handle 14 comprises an open grid having openings 20. The outer surface of each side wall 8 is provided with a slightly recessed branding panel 22 which may be provided with advertising indicia or other information. Because branding panel 22 is recessed from the outer surface of side wall 8, labels applied to it are protected from abrasion by adjacent cases.

Figures 7, 8, 9:
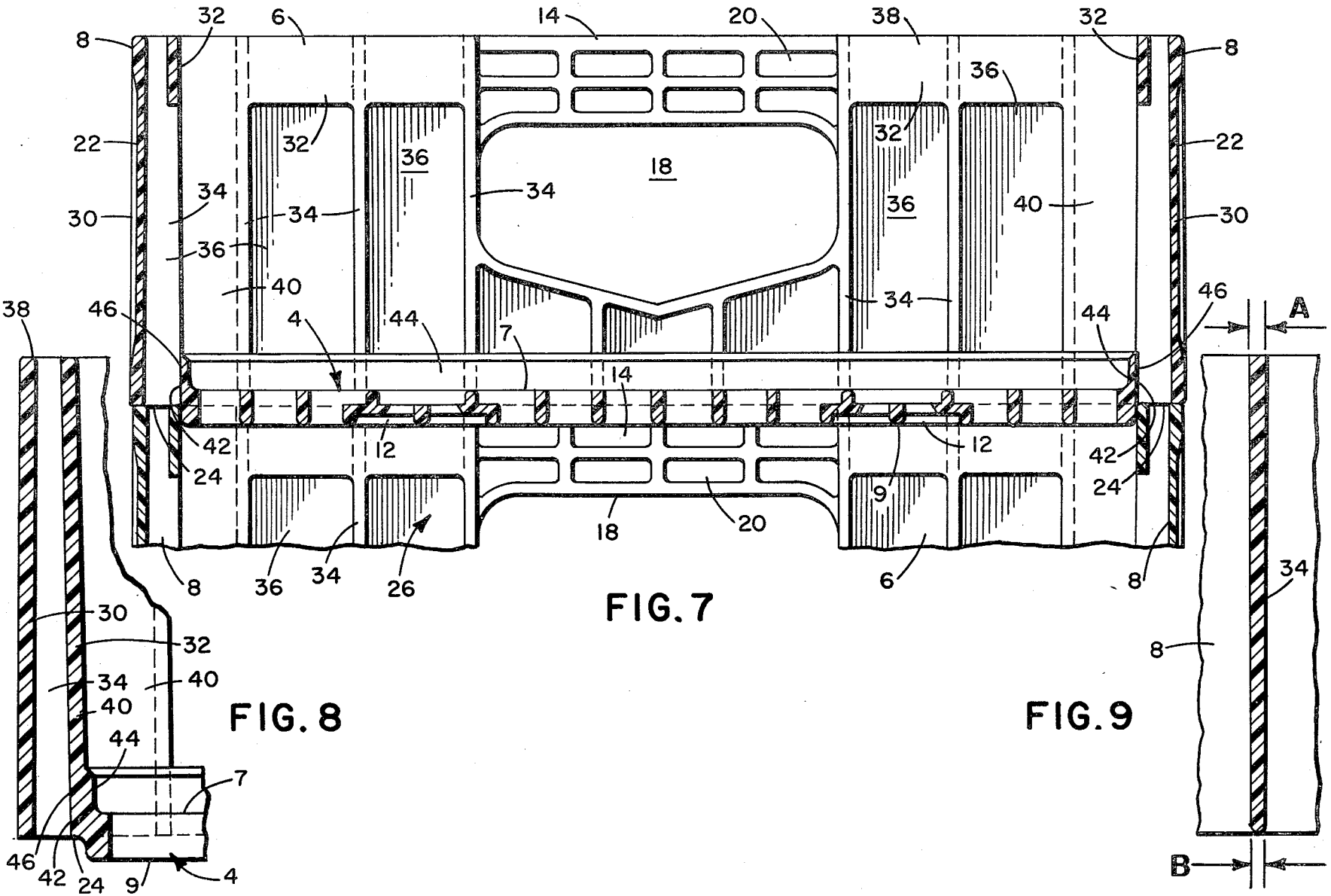
FIG. 7 is a sectional view of the same along line 7—7 of FIG. 3, showing the nesting feature of the case.
FIG. 8 is a detail sectional view of the same along line 8—8 of FIG. 3.
FIG. 9 is a detail sectional view of the same along line 9—9 of FIG. 3.

FIG. 7 illustrates the nesting feature of the case according to the invention. The case is provided with a bottom peripheral recess 24 formed by the intersection of bottom wall 4, end walls 6 and side walls 8. Recess 24 has a lateral dimension slightly greater than the thickness of the wall above it. Hence, bottom wall 4 fits neatly within the space between the side and end walls of subjacent case 26 when the cases are empty.

End walls 6 and side walls 8 are hollow and of substantially identical construction except or their overall thicknesses. Hence, the following detailed description of the structure of a side wall 8 is also applicable to side walls 6.

Side wall 8 comprises an outer wall 30 joined to an inner wall 32 by means of a plurality of laterally spaced upstanding ribs 34. The spaces between ribs 34 are substantially open from top to bottom, with the exception of those beneath openings 18, which are closed at their tops. A plurality of rectangular openings 36 are formed in inner wall 32. Openings 36 have lateral edges defined by ribs 34, and are spaced below the top edge 38 of inner wall 32 and above the upper supporting surface 7 of bottom wall 4. The spacing between ribs 34 is chosen such that the width of openings 36 is less than the minimum width of the bottles to be placed with the case. This spacing, coupled with the fact that openings 36 are spaced above the upper supporting surface 7 of bottom wall 4, insures that the bottles will not shift laterally into the interior of side wall 8. In order to facilitate the removal of the case from the mold, ribs 34 are tapered so that, as seen in FIG. 9, dimension A is slightly greater than dimension B. As seen in FIG. 8, the corners of the case are reinforced by a portion 40 of inner wall 32 which extends the full height of the case and is connected to bottom wall 4.

Bottom wall 4 has an outwardly facing peripheral edge 42 which is joined directly to ribs 34. The connections between ribs 34 and bottom wall 4 are reinforced by an upstanding peripheral flange 44 carried by bottom wall 4. Flange 44 has an outwardly facing surface 46 which is an extension of the peripheral edge 42 of bottom wall 4. Ribs 34 are also connected to surface 46.

It can readily be seen that a substantial portion of the interior of each of the end walls 6 and side walls 8 is exposed to the inside of the case. Side walls 6 and end walls 8 are also substantially open from top to bottom. This construction facilitates the efficient and thorough washing and drying of the interiors of these walls. In addition, a case constructed in this manner is light in weight, has a high degree of strength and rigidity, and may be reliably used where rigid sanitary requirements must be satisfied.

Although the present invention has been illustrated in terms of a preferred embodiment, it will be obvious to one of ordinary skill that numerous modifications may be made without departing from the true spirit and scope of the invention which is to be limited only by the appended claims.

I claim:

1. A carrying case having a bottom wall with an upper supporting surface, and an upstanding wall connected to said bottom wall, at least a portion of said upstanding wall being hollow and comprising:

an outer wall having a substantially imperforate portion;

an inner wall spaced inwardly from said outer wall; and a plurality of openings formed in said inner wall to expose the interior surface of the imperforate portion of said outer wall to facilitate cleaning thereof.

2. A case according to claim 1 for holding an array of upstanding containers, each of said openings having generally upstanding lateral edges and a maximum width which is less than the minimum width of the containers held in the case.

3. A case according to claim 1 wherein said openings are laterally spaced and have generally upstanding lateral edges.

4. A case according to claim 3 further comprising a plurality of laterally spaced upstanding ribs interconnecting said outer and inner walls, said ribs defining said lateral edges of said openings.

5. A case according to claim 3 or 4 wherein each of said openings has a height equal to at least one-half the height of said inner wall.

6. A case according to claim 5 wherein said openings are substantially rectangular.

7. A case according to claim 1 wherein said openings are spaced above the upper surface of said bottom wall.

8. A case according to claim 1 wherein said openings are spaced below the top of said inner wall and above the upper surface of said bottom wall.

9. A case according to claim 1 or 8 wherein said upstanding wall is substantially open from top to bottom to facilitate the cleaning of its interior.

10. A plastic carrying case having a generally rectangular bottom wall with an upper supporting surface, upstanding side and end walls connected to said bottom wall and a handle formed in each of said end walls, each of said side and end walls being hollow and comprising:

an outer wall having a substantially imperforate portion;

an inner wall spaced inwardly from said outer wall;

a plurality of laterally spaced upstanding ribs interconnecting said outer and inner walls; and a plurality of openings formed in said inner wall spaced below the top of said inner wall and above the upper surface of said bottom wall to expose the interior surface of the imperforate portion of said outer wall to facilitate cleaning thereof.

11. A case according to claim 10 wherein said openings are laterally spaced and have upstanding lateral edges defined by said ribs.

12. A case according to claim 11 wherein substantially all of said openings have heights equal to at least one-half the height of said inner wall.

13. A case according to claim 12 for holding an array of upstanding containers, each of said openings having a maximum width which is less than the minimum width of the containers held in the case.

14. A case according to claim 12 or 13 wherein said openings are substantially rectangular.

15. A case according to claim 14 wherein each of said side and end walls is substantially open from top to bottom to facilitate the cleaning of its interior.

* * * * *